United States Patent [19]

Ritter et al.

[11] 4,023,600

[45] May 17, 1977

[54] METHOD OF PRODUCING WIRE MESH

[75] Inventors: Gerhard Ritter; Klaus Ritter, both of Graz, Austria

[73] Assignee: Firma Evg Entwicklungs-u Verwertungsgesellschaft, Graz, Austria

[22] Filed: Oct. 6, 1975

[21] Appl. No.: 619,950

[30] Foreign Application Priority Data

Oct. 10, 1974 Austria ..... 8179/74

[52] U.S. Cl. ..... 140/112; 140/107

[51] Int. Cl.[2] ..... B21F 27/10

[58] Field of Search ..... 219/58, 57; 148/12 B; 245/2, 8; 140/107, 112

[56] References Cited

UNITED STATES PATENTS

| | | | |
|---|---|---|---|
| 1,071,822 | 9/1913 | Storey | 245/8 |
| 1,942,451 | 1/1934 | Reynolds | 245/8 |
| 2,094,074 | 9/1937 | Lee et al. | 245/2 |
| 3,454,054 | 7/1969 | Docker | 140/107 |
| 3,573,418 | 4/1971 | Amakasu et al. | 219/58 |

FOREIGN PATENTS OR APPLICATIONS

| | | | |
|---|---|---|---|
| 1,151,212 | 7/1963 | Germany | 140/107 |

*Primary Examiner*—Lowell A. Larson
*Attorney, Agent, or Firm*—Ernest F. Marmorek

[57] ABSTRACT

The invention relates to a method of producing wire mesh having relatively high elongation values and high pliability wherein the wire is not annealed until after having been welded up into the mesh.

8 Claims, 1 Drawing Figure

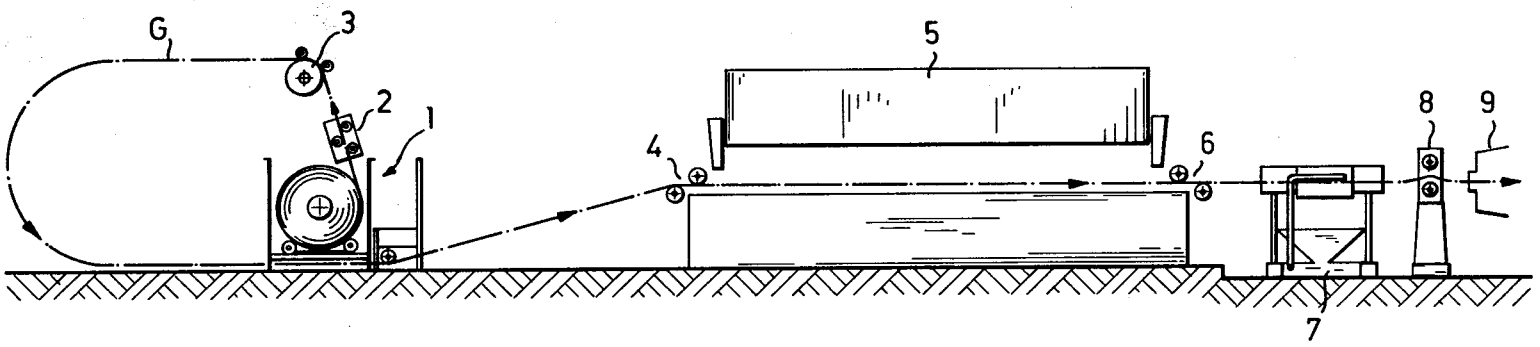
G
3
2
1
4
5
6
7
8
9

METHOD OF PRODUCING WIRE MESH

For many purposes such as for fences, cages or baskets, wire mesh, having relatively high elongation values, say, elongation values of over 15% and high pliability, are needed. Frequently, these meshes which may be welded or woven are protected against corrosion by galvanizing or coating with plastics.

In the production of mesh of that kind, one usually starts with unalloyed low-carbon wire rod material of a diameter of 5.5 mm or over. This wire material is brought down by cold drawing or cold rolling to the required wire thickness and then annealed in order to relieve the hardening of the wire effected by the cold working and to be able from this to produce wire mesh having the required characteristics. For production of galvanized mesh, the wire may already be galvanized before its manufacture into a moven or welded mesh.

Within the scope of the annealing operation the necessary introduction of the wire material in the form of a ring into an annealing furnace, the removal of the rings from it as well as the subsequent cooling of the rings in a cooling installation represent costly operations before the actual manufacture of the wire material into mesh.

The invention is based on recognition that for of the production of welded mesh of the kind specified above the costly annealing operation upon the wire itself can be avoided and replaced by a later annealing operation upon the mesh, which can be performed considerably more simply.

Thus, in accordance with the invention, in a method of producing wire mesh having relatively high elongation values and high pliability, from unalloyed low-carbon wire rod material which by cold drawing or cold rolling is brought to the required wire thickness, the cold-worked wire material produced by cold drawing or cold rolling is manufactured, preferably by electrical resistance welding, into a welded mesh and only then, if necessary in the form of a reel, is subjected to an annealing operation at between 600°–1000° C, which guarantees the required relatively high elongation values and high pliability of the mesh.

It is readily evident that the annealing operation on a mesh strip which can be effected in a batch process by introduction of the mesh strip in reel form into an annealing furnace or else in a continuous process by taking the mesh strip through a continuous-heating furnace, can be performed considerably more simply than an annealing operation upon the wire material preceding the production of the mesh. This advantage in the production of welded mesh, which as is known is effected by the welding of straight longitudinal wires and straight transverse wires crossing them, can in fact be made the most of, because with this production process, in contrast to the production of woven mesh, a high ductility of the wire is not necessary.

The invention enables further simplification in industrial processing as compared with the state of the art, in the production of galvanized wire mesh if the welded mesh strip is passed continuously through a continuous-heating furnace, preferably a radiation furnace, for the annealing operation and after that via a cooling device next in line, through a continuous galvanizing plant. Hence, in this case, starting with welded mesh strips in reel form, the annealing operation of the wire material and the galvanizing of it can be performed in one common pass. Galvanizing of the welded mesh instead of the wire which is to be manufactured into the mesh offers the advantage that the formation of noxious zinc vapours during welding of the mesh is avoided.

For the production of wire mesh coated with plastics, one can similarly proceed in such a way that the welded mesh strip is passed continuously through a continuous-heating furnace, preferably a radiation furnace, for the annealing operation, and after that via a cooling device next in line, and through a plastics-coating plant.

Preferably, the annealing operation is effected in a protective gas atmosphere.

The accompanying drawing illustrates diagrammatically in side elevation an installation for carrying out the method in accordance with the invention for the production of galvanized mesh, in which the mesh welded directly from cold-worked wire material and wound into a reel is subjected to the subsequent annealing operation and is galvanized directly afterwards.

In an installation for use in accordance with the invention for production of wire mesh any known mesh-welding machine may be employed in which onto a family of longitudinal wires running up in parallel, transverse wires are welded by electrical multispot welding. In that case, although wire mesh having relatively high elongation values and high pliability are to be produced, the wires which are fed directly to the mesh-welding machine, have been brought by cold working to the required wire thickness and have thus not been annealed and are therefore not very ductile and not very flexible, and the mesh strip produced is preferably before further treatment, wound into a reel.

A reel of this mesh is slid in the axial direction onto the mandrel of a wind-off mechanism 1 of the portion of the installation illustrated in the drawing. From this mesh reel the mesh strip G is drawn off by means of feed-rolls 2 over a set of guide-rolls 3 beyond which the mesh strip, forming a loop, is guided back to a channel passing through the bottom part of the wind-off mechanism 1, in order to be led to a continuous-heating furnace 5, the inlet and outlet ends of which are associated guide rolls 4 and 6. The continuous-heating furnance is preferably formed as a radiation furnace and is so operated that the wire mesh passing through gets annealed at a temperature of maximum 1000° C, so that it acquires the required high elongation values of, say 15% or over and the required relatively high ductility. If necessary a protective gas atmosphere is maintained in the continuous-heating furnace 5.

The annealed wire mesh beyond the continuous-heating furnace 5 passes through a cooling device 7 which, for example, contains a water bath and the temperature of the wire material drops to, say, 60°–80° C. Beyond the cooling device 7 there follows a galvanizing plant, in itself known, of which only a pair of feed-rolls 8 at the inlet end and the start of a pickling bath 9 are illustrated, but which besides the necessary feed devices exhibits in known manner beyond the pickling bath a flush-down, and connected to this a bath of killed spirits, a drier, a zinc bath and finally a reeler mechanism for the finish-galvanized mesh strip.

Also in a similar way the installation can be constructed for production of mesh coated with plastics.

If necessary the continuous-heating furnace may also be arranged directly beyond the mesh welding machine and the welding of the mesh from cold-worked wire material, the annealing of the mesh in the continuous-heating furnace and the galvanizing or coating of the annealed mesh can be effected in one continuous process.

We claim:

1. In a method of producing from rods wire mesh having relatively high elongation values and high pliability, the steps comprising:

cold working unalloyed low carbon wire rods to reduce the thickness of each to a predetermined thickness;

thereafter forming said wire mesh from said wire rods including positioning said rods relative to each other and immobilizing them in said position; and annealing said wire mesh at a temperature of from about 600° to about 1,000° C.

2. The method as claimed in claim 1, wherein said wire mesh is formed by the use of electrical resistance welding.

3. The method as claimed in claim 1, further comprising the step of reeling said wire mesh prior to the annealing.

4. The method as claimed in claim 1, wherein said annealing is carried out by passing said wire mesh continuously through a continuous-heating furnace and then a cooling station and further comprising thereafter, galvanizing said wire mesh.

5. The method as claimed in claim 4, wherein said continuous-heating furnace is a radiation furnace.

6. The method as claimed in claim 4, wherein said annealing is carried out by passing said wire mesh continuously through a continuous-heating furnace and then a cooling station and further comprising, thereafter, applying a plastic coating to said wire mesh.

7. The method as claimed in claim 6, wherein said continuous-heating furnace is a radiation furnace.

8. The method as claimed in claim 1, wherein said annealing is carried out in a protective gas atmosphere.

* * * * *